US006471099B2

(12) United States Patent
Arabnia

(10) Patent No.: US 6,471,099 B2
(45) Date of Patent: Oct. 29, 2002

(54) METERING DEVICE FOR WATER OR SOLVENT PAINT VESSEL COVERS

(76) Inventor: Ali Reza Arabnia, Via Pelizza de Volpedo, 109, 20092 Cinisello Balsamo (Milano) (IT)

( * ) Notice: Subject to any disclaimer, the term of this patent is extended or adjusted under 35 U.S.C. 154(b) by 0 days.

(21) Appl. No.: 09/789,025

(22) Filed: Feb. 20, 2001

(65) Prior Publication Data

US 2001/0027985 A1 Oct. 11, 2001

(30) Foreign Application Priority Data

Apr. 6, 2000 (IT) ..... MI00A0742
Jul. 31, 2000 (IT) ..... MI00A1777

(51) Int. Cl.[7] ..... B67D 3/00
(52) U.S. Cl. ..... 222/484; 222/561; 259/122
(58) Field of Search ..... 222/484, 505, 222/556, 561, 568, 569, 473; 259/122, 43

(56) References Cited

U.S. PATENT DOCUMENTS 3,021,118 A * 2/1962 Dedoes ..... 222/484
3,041,052 A * 6/1962 Dedoes ..... 222/484
4,750,648 A * 6/1988 Krydiak ..... 222/484
4,852,775 A * 8/1989 Zordan ..... 222/569
5,267,675 A * 12/1993 Cane ..... 222/556

* cited by examiner

*Primary Examiner*—Lesley D. Morris
*Assistant Examiner*—Melvin A. Cartagena
(74) *Attorney, Agent, or Firm*—Hedman & Costigan, P.C.

(57) ABSTRACT

A metering device to be applied to a cover including a delivery spout, comprising a cover body having a gripping handle, a projecting element bearing the delivery spout thereon, on which a guillotine shutter element can slide, including a tongue element and driven by a tie-rod controlled by a push-button.

4 Claims, 5 Drawing Sheets

METERING DEVICE FOR WATER OR SOLVENT PAINT VESSEL COVERS

BACKGROUND OF THE INVENTION

The present invention relates to a metering device including a delivery spout, which has been specifically designed for application to water or solvent paint vessels and the like.

Covers including a metering spout are already commercially known.

In particular, the delivery spout is controlled by a shutter element which can be driven by a pressure means including either a pressing lever or a push-button.

This cover is applied to paint vessels and the like by clamping systems which are conventionally engaged with a flange provided on an edge portion thereof.

The flange is arranged at the top face of the vessel and defines the cover application region, for engaging the cover for tightly closing the vessel.

The above mentioned paint vessels, however, are affected by operating drawback since the mentioned flange arrangements can have different size; a further drawbacks is that the paint held in the vessel cannot be reliably metered and delivered.

Moreover, prior paint vessel covers are rather complex from a constructional standpoint, and have a comparatively high cost.

Furthermore, they can be hardly serviced and cleaned.

In fact, prior delivery spouts have their paint outlet side including cutting edges, since they have a substantially trapezoidal or polygonal configuration.

In actual practice, it has been found that paint can accumulate at the cutting corner regions, so that the delivery spout can be easily blocked.

SUMMARY OF THE INVENTION

Thus, the aim of the present invention is to overcome the above mentioned problems, while allowing the plastic material elements applied to the cover to be easily and accurately molded.

Another object of the present invention is to allow the paint delivery spout to be easily changed for servicing and/or cleaning purposes.

Yet another object of the invention is to allow the paint delivery spout to be easily and quickly cleaned without discarding the cover.

Yet another object of the present invention is that of allowing the delivery spout to be easily and quickly changed with another differently sized delivery spout.

To the above it is to be further added that prior guillotine shutter elements, as urged by a closing spring, frequently wear the top edge portion of the delivery spout, which, after a period of use, cannot provide a perfectly sealed connection, thereby compelling the operator to replace the overall cover.

Thus, a further object of the present invention is to provide such a paint metering device, to be applied to a paint vessel cover, which includes a paint delivery spout which, in addition, can be easily oriented.

A further object of the present invention is to provide a perfectly sealed connection between the paint delivery spout and the guillotine element.

Yet another object of the present invention is to provide a metering device to be applied to a cover including a delivery spout, specifically designed for paint vessels and the like, which can be easily disassembled and reassembled thereby allowing the constructional elements to be easily cleaned, and which can be firmly applied to the paint vessel without deforming or damaging the cover, to always provide a perfect sealed connection.

Yet a further object of the present invention is to provide a delivery device-spout and cover assembly which is very reliable and safe in operation.

Yet another object of the present invention is to provide such a device which can be easily made starting from easily available elements and materials and which, moreover, is very competitive from a mere economic standpoint.

According to one aspect of the present invention, the above mentioned objects, as well as yet other objects, which will become more apparent hereinafter, are achieved by a metering device for application to a cover including a delivery spout, controlled by a guillotine closure element, characterized in that said device comprises a delivery spout, including front and side contoured elements, and spout closing elements, including a plastic material tongue operating as a guillotine element which can be easily deformed to provide an accurate metering of the product held in a vessel.

BRIEF DESCRIPTION OF THE DRAWINGS

Further characteristics and advantages of the present invention will become more apparent hereinafter from the following disclosure of a preferred, though not exclusive, embodiment of a metering device for application to a cover, including a delivery spout, for paint vessels and the like, and being shown, by way of an indicative, but not limitative, example in the accompanying drawings, where.

DESCRIPTION OF THE PREFERRED EMBODIMENTS

Figure 1:
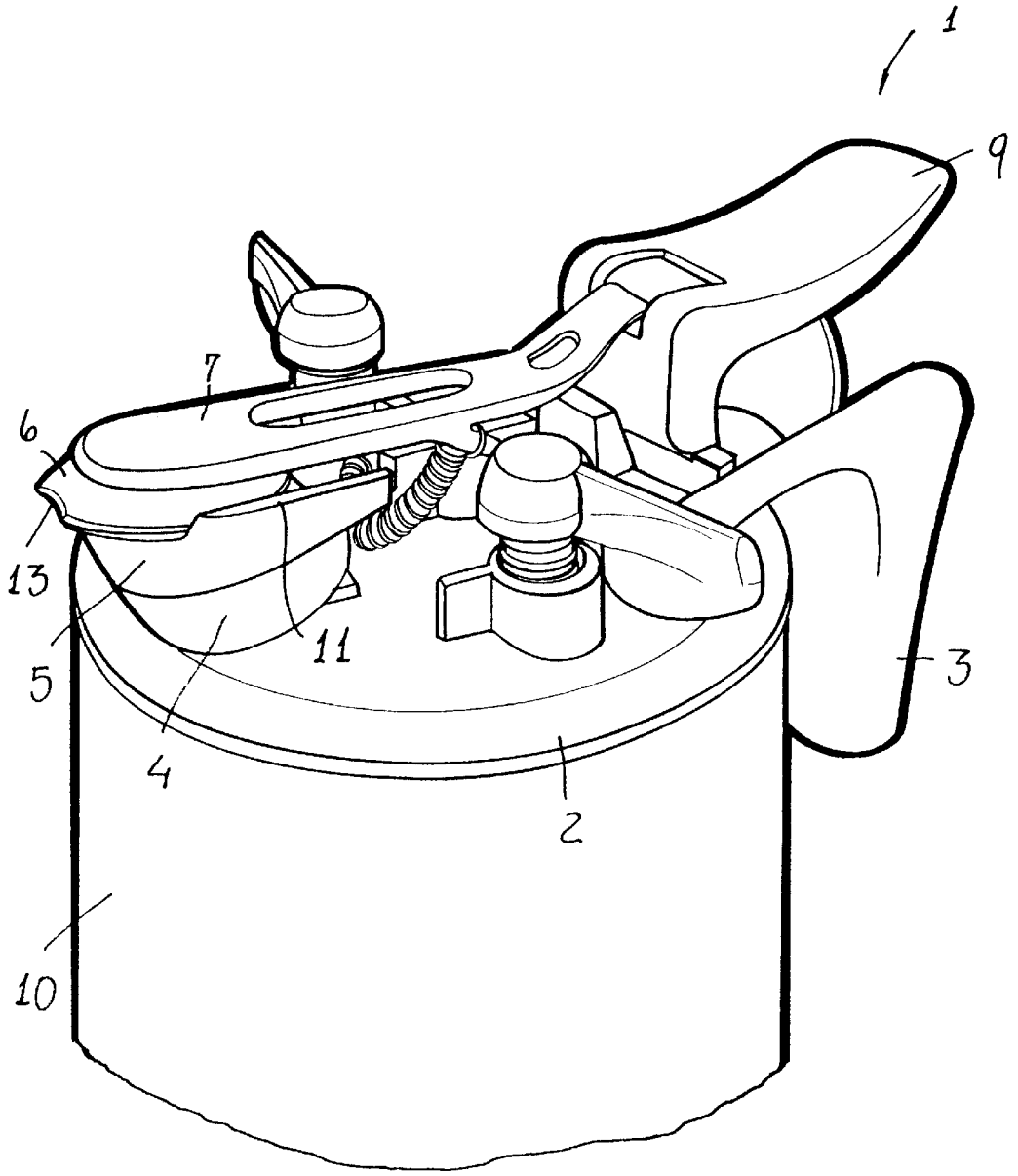
FIG. 1 is a schematic side perspective view illustrating the metering device according to the invention.
Figure 2:
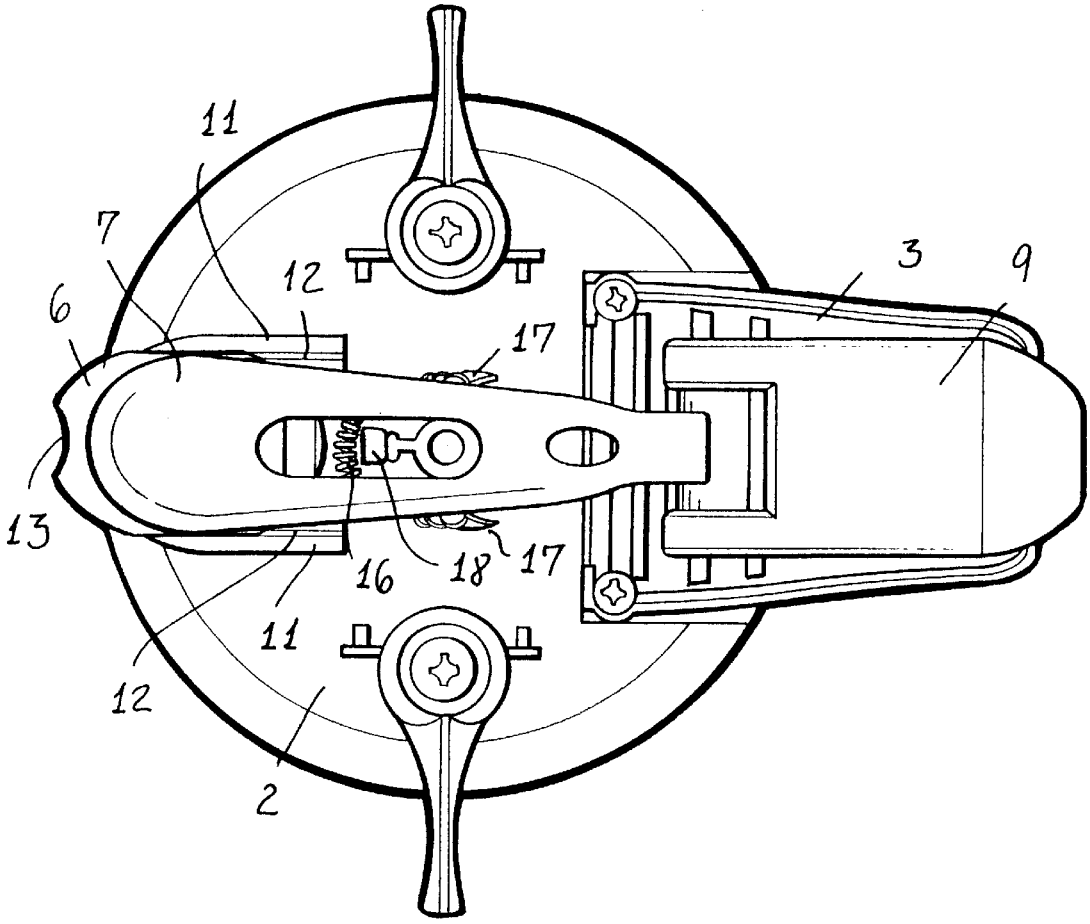
FIG. 2 is a top plan view illustrating that same metering device.
Figure 3:
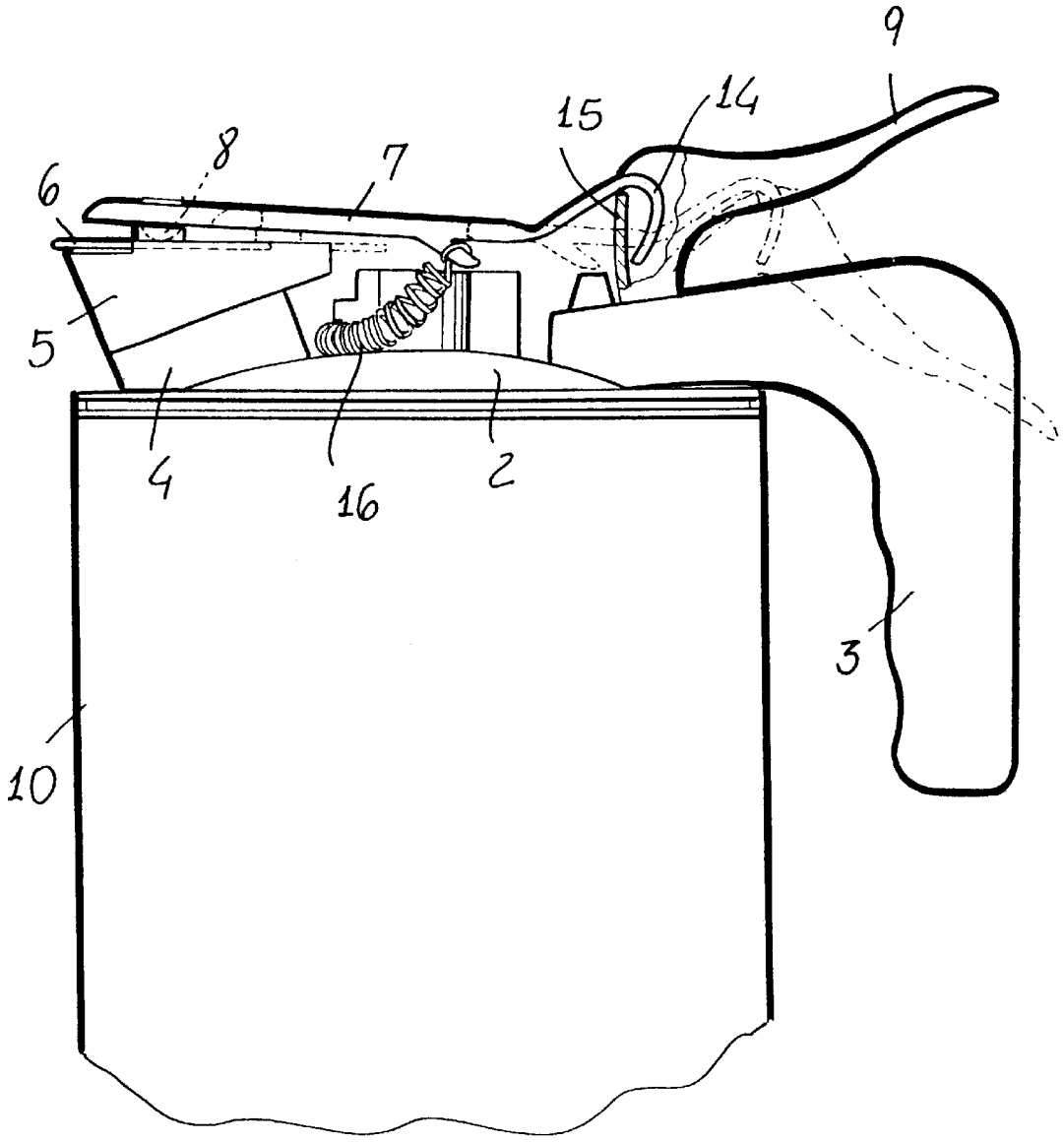
FIG. 3 is a side view illustrating the metering device according to the invention applied to the cover, and further illustrating, by a dashed line, the opening position of the delivery spout.
Figure 4:
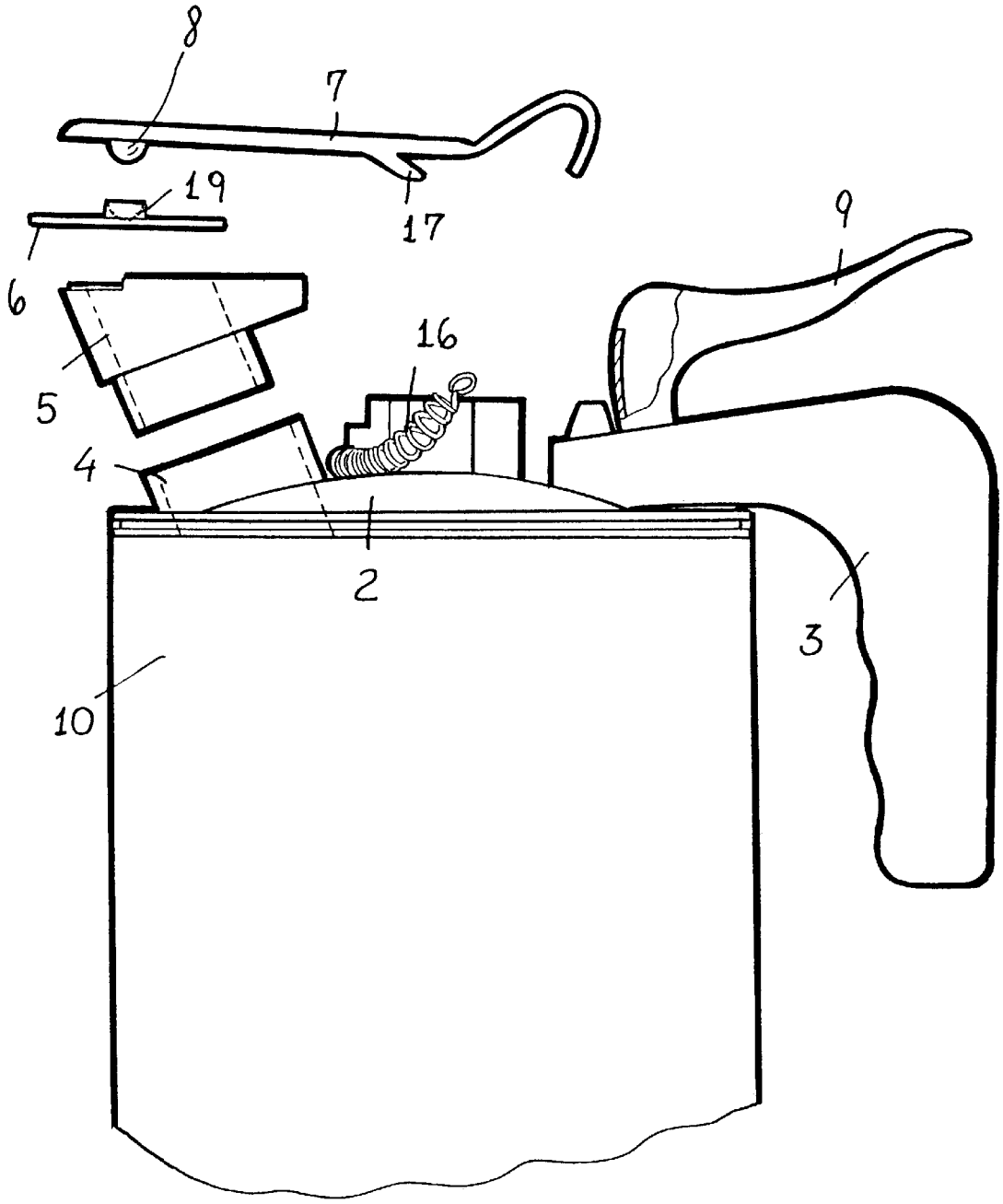
FIG. 4 is an exploded side view of the metering device according to the invention.
Figure 5:
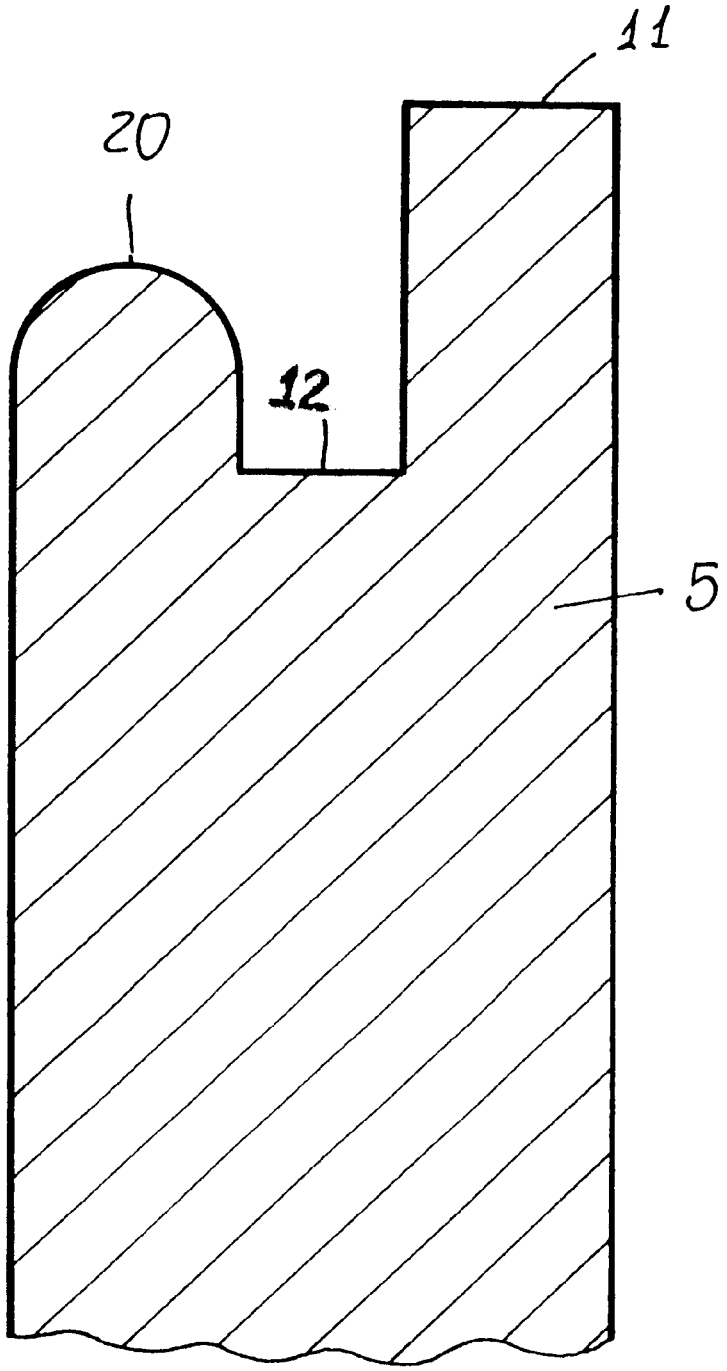
FIG. 5 is a cross-sectioned side view of the side contour of the delivery spout.

With regard to the reference characters of the above mentioned figures, the paint or the like metering device according to the present invention is applied to a cover including a delivery spout specifically designed for paint vessels and the like.

More specifically, the metering device has been herein generally indicated by the reference number 1 and comprises a cover body 2 which is preferably provided with a gripping handle 3.

Said cover 2 further comprises a projecting element 4, thereon the delivery spout 5 is applied.

On said delivery spout 5 can slide a guillotine shutter element, comprising a tongue 6 driven by a tie-rod 7, in turn driven by the driving lever 9.

The main feature of the invention is that the metering device can be easily disassembled and re-assembled, thereby allowing its constructional elements to be simply and efficiently cleaned.

The elements forming said metering device, in particular, comprise the mentioned delivery spout 5, applied to a fitting including a projecting element 4, of tubular construction and formed in the body of the cover 2.

The delivery spout 5 has, in plan, a front curved contour, and includes guide sidewalls 11 which project from the top contour of the delivery spout.

Between the mentioned projecting guides side walls 11 and the upper contour of the delivery spout 5, a plurality of slots 12 are formed, for allowing a proper finishing grinding of the top contour of said delivery spout 5.

The delivery spout 5 comprises moreover, to provide a perfect sealing, a top surface 20 having a curved cross-section, the convexity of which is upward directed.

Said guide contour 11 and recessed slots 12, as stated, allows to facilitate a possible grinding operation, and will provide a perfect sealing between the delivery spout 5 and the tongue 6, which latter operates as a guillotine for "closing" and "opening" the mentioned delivery spout 5.

As shown, the delivery spout 5 ends with a rounded contour, improving its contact with the tongue 6, the latter being made of a deformable plastic material, to perfectly fit the upper contour of the delivery spout 5.

The tongue 6 is moreover provided, at the front thereof, with a curved contour or portion, having an outwardly directed concavity 13.

This specifically designed contour assures a micro-metering and an accurate delivery of the product held in the vessels 10 to which the cover 2 would be applied.

The subject device comprises moreover a top tie-rod 7 having an elongated configuration which ends, at the bottom thereof, with a half-spherical element 8 pressing on the tongue 6.

Said tie-rod element 7 ends, at the rear thereof, with a hook tooth element 14 which can be coupled to a cross rod 15 or other like element, formed in a push-button 9 pivoted either to the cover 2 or to the gripping handle.

Said tie-rod 7 comprises moreover, on a side thereof, two tooth or slot elements 17, to which are coupled the end portions of a spring 16 anchored to a clamping tooth element 18, formed on the top surface of the cover 2.

A further main feature of the invention is that the top edge of the delivery spout 5, is provided, at least at the paint outlet edge, with a curved contour.

Advantageously, the delivery spout 5 has a circular cross-section about its axis, which is inclined with respect to the plane defined by the cover.

Thus, by providing a continuously curved edge, any accumulation of materials is prevented from occurring.

Moreover, said delivery spout 5 had its end portion 5 replaced which can be removably coupled to the cover 2, thereby allowing it to be easily replaced, upon wearing.

Actually, said delivery spout 5 can be easily replace and, as it is worn, it would not be necessary to replace the overall cover, but only the delivery spout 5 which, as stated, can be easily changed.

The delivery spout 5 has a cross section free of any cutting corners, that is it is nearly perfectly circular or ellipsoidal.

The tie-rod 7, in turn, is coupled to the tongue 6 by an articulated link or ball joint, comprising, in addition to the above mentioned half-spherical element 8, a second half-spherical concave element 19, coupled to the tongue 6 and provided for housing the first element therein.

This provision would allow to apply an evenly distributed pressure on the tongue 6.

Moreover, it is also possible to swingably drive the tie-rod 7, to provide, under any conditions and at any positions, a constant pressure on the tongue.

This result would be obtained even if the delivery spout 5 would not be perfectly assembled.

The delivery spout 5, as seen in side cross-section, is provided with an inner wall 20 having a top curved contour, a slot 12 and an outer guide wall 11.

The spring 16 provides two effects on the tongue 6, while assuring a perfect closure, as the push-button 9 is released.

Said spring 16, moreover, provides a suitable pressure on the tongue 6, thereby perfectly sealing the cover 2.

In this connection it should be pointed out that the cover 2 would be applied to the body of the vessel 10 by known clamping means, designed for providing a tight closure.

From the above disclosure it should be apparent that the invention fully achieves the intended objects.

In particular, the fat is to be pointed out that the subject metering device has been specifically designed for application to a cover including a delivery spout, specially studied for paint vessels and the like, to provide a micro-metering of the paint, while allowing a quick and simple cleaning, since it can be easily disassembled and reassembled.

The invention, as disclosed, is susceptible to several modifications and variations, all of which will come within the scope of the invention.

Moreover, all the constructional details can be replaced by other technically equivalent elements.

In practicing the invention, the used materials, as well as the contingent size and shapes, can be any, according to requirements.

What is claimed is:

1. A metering device for application to a paint vessel cover, said cover comprising a cover body including a gripping handle and a projecting element supporting a paint delivery replaceable spout in which a guillotine shutter controlling element including a tongue element coupled to a push-button driven controlling tie-rod, said delivery spout having a front curved contour and guide side walls extending from a top portion of said delivery spout, said side walls including top recessed slots, said tongue element being made of a plastic material and having a curved profile with an outward directed front concavity, wherein said tie-rod had a bottom portion includes a half-spherical element, pressing on said tongue element.

2. A metering device, according to claim 1, wherein said tie-rod including a rear hook tooth element engaged with a cross rod formed in a push-button pivoted to said cover or gripping handle.

3. A metering device, according to claim 1, wherein said tie-rod comprises two side tooth elements, to which are coupled respective end portions of a spring, anchored at a central portion of a holding tooth element of said cover.

4. A metering device, according to claim 1, wherein said tie-rod is coupled to said tongue element by an articulated joint including a first half-spherical element and a second concave half-spherical element being applied to said tongue element and housing said first half-spherical element.

* * * * *